US006410091B1

(12) United States Patent
Jasani et al.

(10) Patent No.: US 6,410,091 B1
(45) Date of Patent: Jun. 25, 2002

(54) PLASTISOL-PRINTED DYED POLYESTER FABRICS AND METHOD OF PRODUCING SAME

(75) Inventors: Kantilal A. Jasani, Pine Grove, PA (US); Phillip D. McCartney, Greensboro, NC (US)

(73) Assignee: Guilford Mills, Inc., Greensboro, NC (US)

( * ) Notice: Subject to any disclaimer, the term of this patent is extended or adjusted under 35 U.S.C. 154(b) by 0 days.

(21) Appl. No.: 09/299,802

(22) Filed: Apr. 26, 1999

(51) Int. Cl.[7] ..... B05D 1/38

(52) U.S. Cl. ..... 427/258; 427/260; 427/265; 427/288

(58) Field of Search ..... 427/258, 260, 427/261, 265, 282, 288; 442/66, 71; 101/129; 8/478; 428/201; 28/169

(56) References Cited

U.S. PATENT DOCUMENTS

| | | | |
|---|---|---|---|
| 2,819,253 A | | 1/1958 | Gateff et al. |
| 4,351,781 A | | 9/1982 | Lewis et al. |
| 4,440,590 A | * | 4/1984 | Collins et al. |
| 4,455,147 A | | 6/1984 | Lewis et al. |
| 4,576,610 A | | 3/1986 | Donenfeld |
| 4,725,849 A | | 2/1988 | Koike et al. |
| 4,795,675 A | | 1/1989 | Dunn, et al. |
| 5,015,261 A | | 5/1991 | Donenfeld et al. |
| 5,174,792 A | | 12/1992 | Tsumura et al. |
| 5,344,620 A | | 9/1994 | Reiners et al. |
| 5,578,088 A | | 11/1996 | Schrell et al. |
| 5,680,893 A | * | 10/1997 | Neer |

FOREIGN PATENT DOCUMENTS

| | | | |
|---|---|---|---|
| JP | 77-038445 | * | 9/1977 |

* cited by examiner

*Primary Examiner*—Fred J. Parker
(74) *Attorney, Agent, or Firm*—Kennedy Covington Lobdell & Hickman, LLP

(57) ABSTRACT

Dyed polyester fabrics may be printed with a plastisol printing composition substantially without dissolving the dye in the polyester fabric by initially applying a blocking composition to the fabric to form a printing receptor barrier, after curing of the blocking composition, imprinting the plastisol in a desired image or pattern onto the barrier and finally curing the print. The barrier substantially separates the fabric and the plastisol from one another to prevent chemical interaction between the printing composition and the dye in the polyester fabric, thereby to prevent undesired discoloration of the printing composition.

20 Claims, 2 Drawing Sheets

PLASTISOL-PRINTED DYED POLYESTER FABRICS AND METHOD OF PRODUCING SAME

BACKGROUND OF THE INVENTION

The present invention relates generally to the dyeing and printing of textile products, and more particularly, to the printing of dyed polyester fabrics with a plastisol printing composition.

Polyester and nylon fibers are the two synthetic textile fibers most commonly and widely used in the production of textile fabrics, particularly fabrics used in the manufacture of apparel. While each fiber has differing physical and chemical characteristics, both fibers are generally suitable for a wide variety of apparel applications. Since polyester fibers typically are considerably less expensive to manufacture, fabrics made of polyester yams tend to be preferred over nylon fabrics in applications for which both types of fibers would be suitable.

One application, however, for which polyester yams are conventionally deemed to be unsuitable are applications in which the fabric is to be imprinted with a composition having an ink or dye dissolved in a plastisizer or similar solvent, commonly referred to as a "plastisol". For the most part, polyester fibers are dyeable only by means of disperse dyes which, unfortunately are soluble in the plastisizers used in plastisol printing compositions. Thus, when a dyed polyester fabric is printed using a plastisol printing composition, the plastisizers in the plastisol act as a solvent for the disperse dyes in the polyester fabric and tend to leach the disperse dyes from the polyester fabric into the printing composition. As a result, the printed designs or images tend to become blurred and to appear stained, especially when a white or light colored plastisol composition is used.

Nylon fabrics, on the other hand, are commonly dyed using acid-based dyes which are unaffected by the plastisizers in plastisol printing compositions. Hence, in fabric applications wherein it is desired to imprint the fabric using a plastisol printing composition, especially of a white or other light color, nylon fabrics are the fabric of choice, even though more expensive than polyester fabrics. One such application is the printing of letters or numbers on athletic jerseys, but of course there are numerous other fabric applications in which single or multi-color printing with a plastisol composition would be desirable.

SUMMARY OF THE INVENTION

It is accordingly an object of the present invention to provide a process by which a dyed polyester fabric may be printed with a plastisol printing composition without the conventional problem of dissolving and leaching the dye of the fabric into the printing composition. An additional object of the present invention is to provide a resultant fabric of polyester yams not only dyed but also printed with a plastisol composition.

Briefly summarized, the present invention achieves these objectives by applying a blocking composition to a selected surface area of a dyed polyester fabric which is desired to be printed with a plastisol printing composition, in order to form a printing receptor barrier over the selected fabric area, following which the plastisol printing composition is imprinted in a desired image or pattern onto the barrier in the selected fabric area. Basically, the barrier substantially separates the fabric and the plastisol printing composition from one another to prevent chemical interaction between the plastisizer or other solvent in the printing composition and the dye in the polyester fibers of the fabric, thereby preventing undesired discoloration of the printing composition. Dyed polyester fabrics thusly printed comprise another aspect of the present invention.

As more fully described hereinafter, various chemical compositions may be utilized as the blocking composition and may be applied in differing manners to a dyed polyester fabric without departing from the substance or scope of the invention. Further details, features and advantages of the present invention will be described and understood from a more detailed disclosure of the present invention set forth below with reference to the accompanying drawings.

DESCRIPTION OF THE PREFERRED EMBODIMENTS

Figure 5:
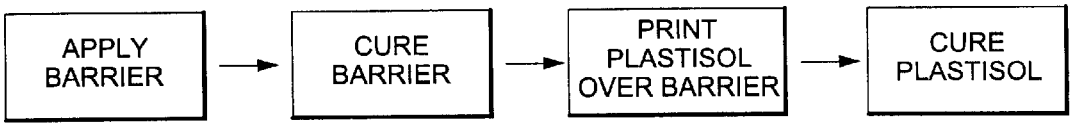
FIG. 5 is a block diagram basically depicting the sequence of steps carried out under the method of the present invention.

As briefly summarized above, the method of the present invention provides for the plastisol printing of dyed polyester fabrics by the fundamental steps of initially applying a chemical blocking composition to a polyester fabric to be printed in order to form a printing barrier, curing the thusly applied barrier, then overprinting onto the barrier the plastisol printing composition in any desired image, design or pattern, and finally curing the plastisol printing composition, as basically represented by the block diagram of FIG. 5. As represented in FIGS. 1–4, one of the common applications for the method of the present invention is contemplated to be the printing of numerals, letters, and other designs onto athletic jerseys and other sportswear and casual wear apparel made of polyester fabrics, such as the numerals 12 printed onto the underlying barrier 14 applied to the body of a football jersey 10 made of dyed polyester fabric.

Those persons skilled in the art will recognize and understand that the present invention has a very broad utility spanning many diverse and varied potential applications for the printing of polyester fabrics, without departing from the fundamental scope and substance of the present invention. Thus, for sake of clarity, the term "polyester" is used herein in its broadest conventional sense and meaning to encompass any thermosetting synthetic resin made by esterification of polybasic organic acids with polyhydric acids and equivalent synthetic compositions. "Polyester fibers" likewise mean any strand-like material made predominantly of polyester in an elongate form, including for example a continuous filamentary, ribbon or tape-like form or a staple length form suitable for use in textile web formation. A "polyester fabric", as used herein, is intended to similarly encompass all web-like materials which include yarns, fibers, ribbons or other fibers made predominantly of polyester and integrated together in a form suitable for use as a textile material or in a textile application. The term "plastisol" or, more specifically, "plastisol printing composition" is also used herein in its broadest conventional sense to mean any composition wherein an ink, dye, stain or other colorant is dissolved or otherwise carried in or by a plastisizer or other composition which acts or tends to act as a solvent for disperse dyes or other colorants now or hereafter used for the dyeing or coloration of polyester fibers or fabrics.

Typically, it is contemplated that the present invention will most often be utilized for the printing of polyester textile fabrics formed by knitting, weaving, non-woven, or another fabric forming methodology wherein yams containing polyester fibers, whether in spun staple length form or continuous filament form and whether or not containing other non-polyester fibers or filaments, are intermeshed in a fabric structure defining interstices between the intermeshed yams. By way of example but without limitation, it is contemplated that the present invention will find significant application in the printing of textile fabrics warp knitted from polyester-containing yams. On the other hand, it is also contemplated that the present invention may be utilized for the printing of non-woven webs of polyester fibers and webs made of polyester fibers in flat or ribbon-like form.

The blocking composition may be substantially any chemical composition capable of being applied to such a web of polyester fabric in a form which will coat the constituent polyester fibers so as to form a barrier separating the polyester fibers from a subsequently applied plastisol printing composition to prevent chemical interaction therebetween. By way of example but without limitation, it is presently contemplated that the blocking composition may advantageously be selected from the group of chemical compositions consisting essentially of aqueous borne epoxies, solvent borne epoxies, high molecular weight cross-linking acrylics, urethanes, high molecular weight silicones, fluorocarbons, thermoplastic resins and thermosetting resins, or a combination thereof, with activated aqueous borne epoxies currently being contemplated to be preferred. However, it is to be understood that the present invention is not intended to be limited to this group of potential blocking compositions.

Figure 1:
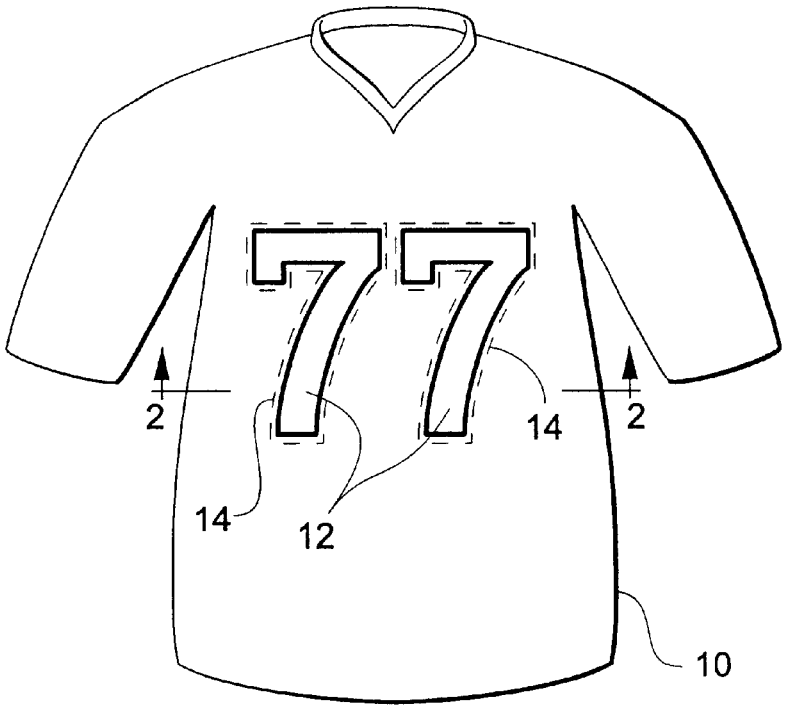
FIG. 1 is an elevational view of a representative football jersey depicting the imprinting thereof with plastisol numerals according to one embodiment of the method of the present invention.
Figure 2:
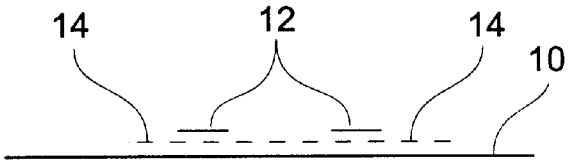
FIG. 2 is a schematic cross-section of the football jersey of FIG. 1, taken along line 2—2 through the printed numerals thereof.
Figure 3:
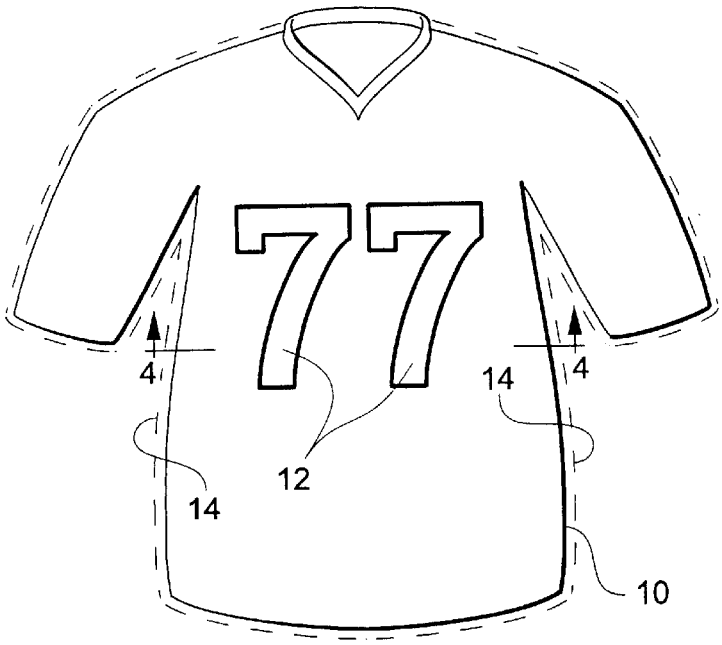
FIG. 3 is another elevational view of a football jersey imprinted with plastisol numerals according to an alternative embodiment of the method of the present invention.
Figure 4:
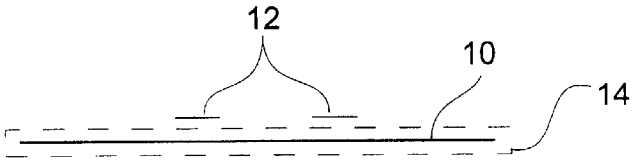
FIG. 4 is a schematic cross-section of the football jersey of FIG. 3 taken along line 4—4 through the printed numerals thereof.

Such blocking compositions may be applied to a polyester web by any of a number of differing application techniques, the manner of application to be chosen in each case according to the particular blocking composition selected, the nature of the intended end use of the polyester web, the intended design, image or pattern in which the plastisol printing composition is to be subsequently applied and any other relevant factor. For example, in some cases, such as the imprinting of numerals or another localized or otherwise discrete image on a clothing article such as a football jersey, it may be most desirable and advantageous to apply the blocking composition selectively only on the area of the fabric to be printed with the plastisol composition and precisely in on the same pattern or design to be printed, as represented by the barrier 14 applied in the form of the intended numerals 12 on the football jersey as depicted in FIGS. 1 and 2. Alternatively, it is also contemplated that the blocking composition may be applied to the entirety of the polyester web to accommodate other applications in which a pattern or design is to be imprinted over the entire surface area of the web, as representatively depicted in FIGS. 3 and 4. The basic method steps of FIG. 5 will remain the same in each case.

Accordingly, depending upon such factors, the blocking composition may be applied by any of numerous known textile finishing techniques including, without limitation, padding, printing (e.g., inkjet, screen printing, etc.), spraying, foaming, immersion coating or any other application technique now or hereafter known. So long as the yarns and the constituent polyester fibers in the textile web become surface coated with the blocking composition, the blocking composition may be applied in any manner which does not affect or only minimally affects the structure, appearance, hand and other physical characteristics of the web.

To insure the optimal effectiveness of the blocking composition, the composition should be cured prior to overprinting by the plastisol printing composition, the particular curing step or technique in each case depending upon the specific blocking compositions selected for the given application. For example, with some blocking compositions, curing will be optimally effected by heating the composition to an elevated temperature for a given period of time to dry and set the blocking composition. Other blocking compositions need only be permitted to dry to become properly cured.

Once the blocking composition has been thusly applied and cured, the plastisol printing composition may be applied by any appropriate technique depending in most cases upon the nature of the printing composition and the desired design, image, or pattern in which the composition is to applied. For example, with numerals or lettering on sportswear, such as the numerals 12 on the football jersey 10 and in other similar applications wherein the barrier formed by the blocking composition is applied selectively in the same intended printing pattern, the plastisol printing composition will preferably be applied by a screen printing or jet printing operation, thereby to obtain optimal registry of the printed image or design with the underlying barrier. In other cases, such as applications in which the design is to be applied over the entire surface area of the fabric, the printing composition may be applied by a roller printing or similar continuous printing operation.

With all of the potential embodiments and applications for the present invention described above, the fundamental advantage achieved in every case is the ability to imprint clear well-defined images onto polyester fabric webs using plastisol printing compositions substantially without the solvent in the printing composition dissolving the dye of the fabric because the barrier formed by the blocking composition effectively separates the fabric and the plastisol printing composition from one another so as to prevent chemical interaction between the plastisizers or other solvent in the printing composition and the dye in the polyester fibers of the fabric. As such, it will now be possible to utilize less expensive polyester fabrics in most of the applications in which heretofore it has been necessary to use more expensive nylon fabrics.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention.

The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method of printing a dyed polyester fabric with a plastisol printing composition substantially without the printing composition dissolving the dye of the fabric, the method comprising:

(a) providing a web of textile fabric to be printed, the fabric containing dyed polyester fibers as a proportion of the content of the fabric;

(b) selecting a surface area of the fabric to be treated with a plastisol printing composition;

(c) applying to at least the selected area of the fabric a blocking composition to form a printing receptor barrier over the selected area; and (d) imprinting the plastisol printing composition in a desired image or pattern onto the barrier in the selected area of the fabric;

wherein the barrier substantially separates the fabric and the plastisol printing composition from one another to prevent chemical interaction between the solvent in the printing composition and the dye in the polyester fibers of the fabric and thereby to prevent undesired discoloration of the printing composition.

2. A method of printing a dyed polyester fabric with a plastisol printing composition according to claim 1, and further comprising curing the blocking composition after being applied to the selected area of the fabric and before imprinting the selected area of the fabric with the plastisol printing composition.

3. A method of printing a dyed polyester fabric with a plastisol printing composition according to claim 1, and further comprising selecting the blocking composition from the group consisting essentially of aqueous-borne epoxies, solvent-borne epoxies, cross, linking acrylics, urethanes, silicones, flourocarbons, thermoplastic resins, and thermosetting resins.

4. A method of printing a dyed polyester fabric with a plastisol printing composition according to claim 1, wherein the applying of the blocking composition to the selected area of the fabric comprises applying the blocking composition to substantially the entire web of the textile fabric.

5. A method of printing a dyed polyester fabric with a plastisol printing composition according to claim 1, wherein the applying of the blocking composition to the selected area of the fabric comprises applying the blocking composition only in a localized area of the fabric.

6. A method of printing a dyed polyester fabric with a plastisol printing composition according to claim 5, wherein applying of the blocking composition to the selected area of the fabric is in substantially the same pattern or image as the desired pattern or image of the plastisol printing composition.

7. A method of printing a dyed polyester fabric with a plastisol printing composition according to claim 6, wherein the imprinting of the plastisol printing composition comprises imprinting the desired image or pattern in registry with the image or pattern of the blocking composition.

8. A method of printing a dyed polyester fabric with a plastisol printing composition according to claim 1, wherein applying of the blocking composition to the selected area of the fabric is in substantially the same pattern or image as the desired pattern or image of the plastisol printing composition.

9. A method of printing a dyed polyester fabric with a plastisol printing composition according to claim 1, wherein the providing of the web of textile fabric comprises providing a textile fabric comprising yarns containing polyester fibers intermeshed in a fabric structure, and the applying of the blocking composition comprises coating the yarns and the polyester fibers thereof with the blocking composition.

10. A method of printing a dyed polyester fabric with a plastisol printing composition according to claim 1, wherein the applying of the blocking composition comprises padding, printing, spraying, foaming, or immersing the fabric with the blocking composition.

11. A method of printing a dyed polyester fabric with a plastisol printing composition according to claim 1, wherein the imprinting of the plastisol printing composition comprises screen printing or jet printing the printing composition onto the fabric.

12. A method of printing a dyed polyester fabric with a plastisol printing composition, wherein the fabric comprises:

(a) a web of textile fabric containing dyed polyester fibers as a proportion of the content of the fabric;

(b) a blocking composition applied to at least a selected area of the fabric and forming a printing receptor barrier over the selected area; and (c) a plastisol printing composition imprinted in a desired image or pattern onto the barrier in the selected areas of the fabric;

wherein the barrier substantially separates the fabric and the plastisol printing composition from one another to prevent chemical interaction between the solvent in the printing composition and the dye in the polyester fibers of the fabric and thereby to prevent undesired discoloration of the printing composition;

the method comprising applying the blocking composition to the textile fabric.

13. A method according to claim 12 of printing a dyed polyester fabric with a plastisol printing composition, wherein the blocking composition is applied only in a localized area of the fabric.

14. A method according to claim 12 of printing a dyed polyester fabric with a plastisol printing composition, wherein the blocking composition is applied in substantially the same pattern or image as the desired pattern or image of the plastisol printing composition.

15. A method according to claim 14 of printing a dyed polyester fabric with a plastisol printing composition, wherein the desired image or pattern of the plastisol printing composition is imprinted in registry with the image or pattern of the blocking composition.

16. A method according to claim 12 of printing a dyed polyester fabric with a plastisol printing composition, wherein the blocking composition is applied in substantially the same pattern or image as the desired pattern or image of the plastisol printing composition.

17. A method according to claim 12 of printing a dyed polyester fabric with a plastisol printing composition, wherein the web of the textile fabric comprises yarns containing polyester fibers intermeshed in a fabric structure defining interstices between the intermeshed yarns, and the blocking composition is applied by coating the yarns and the polyester fibers thereof.

18. A method according to claim 12 of printing a dyed polyester fabric with a plastisol printing composition, wherein the applying of the blocking composition comprises padding, printing, spraying, foaming or immersing the fabric with the blocking composition.

19. A method according to claim 12 of printing a dyed polyester fabric with a plastisol printing composition, wherein the plastisol printing composition is screen printed or jet printed onto the fabric.

20. A method according to claim 12 of printing a dyed polyester fabric with a plastisol printing composition, wherein the blocking composition is applied to substantially the entire web of the textile fabric.

* * * * *